US006982389B2

(12) United States Patent
Riecke et al.

(10) Patent No.: US 6,982,389 B2
(45) Date of Patent: Jan. 3, 2006

(54) DECOUPLED PUSHBUTTONS

(75) Inventors: Jürgen Riecke, Frankfurt (DE); Jörg Essinger, Mühltal (DE); Gil Jose Maria Saez, Zizur Maygor (ES)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 515 days.

(21) Appl. No.: 10/158,274

(22) Filed: May 30, 2002

(65) Prior Publication Data

US 2003/0010610 A1 Jan. 16, 2003

Related U.S. Application Data

(63) Continuation of application No. PCT/EP00/11939, filed on Nov. 29, 2000.

(30) Foreign Application Priority Data

Nov. 30, 1999 (DE) ..... 199 57 643

(51) Int. Cl.
*H01H 13/14* (2006.01)

(52) U.S. Cl. ..... 200/5 A; 200/308

(58) Field of Classification Search ..... 200/5 A, 200/512, 517, 341, 344, 345, 513, 516
See application file for complete search history.

(56) References Cited

U.S. PATENT DOCUMENTS

| | | | | |
|---|---|---|---|---|
| 3,932,722 A * | 1/1976 | Obata et al. | ..... | 200/513 |
| 4,066,860 A * | 1/1978 | Kawasaki | ..... | 200/308 |
| 4,315,114 A | 2/1982 | Monti, Jr. | ..... | 200/5 A |
| 4,490,587 A * | 12/1984 | Miller et al. | ..... | 200/5 A |
| 4,536,625 A * | 8/1985 | Bebie | ..... | 200/5 A |
| 4,604,509 A * | 8/1986 | Clancy et al. | ..... | 200/513 |
| 5,270,507 A | 12/1993 | Nakamura et al. | ..... | 200/511 |
| 5,389,757 A * | 2/1995 | Souliere | ..... | 200/345 |
| 5,481,074 A | 1/1996 | English | ..... | 200/5 A |
| 5,909,804 A * | 6/1999 | Kuratani | ..... | 200/516 |
| 6,187,514 B1 * | 2/2001 | Kiyosawa et al. | ..... | 430/320 |

FOREIGN PATENT DOCUMENTS

| | | |
|---|---|---|
| DE | 30 34 585 C2 | 11/1982 |
| DE | 85 10 147.8 U1 | 6/1987 |
| DE | 94 05 433.9 U1 | 9/1994 |
| GB | 2 084 802 A | 4/1982 |
| JP | 8 083 530 | 3/1996 |

* cited by examiner

*Primary Examiner*—Elvin G. Enad
*Assistant Examiner*—M. Fishman
(74) *Attorney, Agent, or Firm*—John T. Winburn; Russell W. Warnock; Craig J. Loest

(57) ABSTRACT

A pushbutton configuration includes at least two neighboring pushbuttons, connecting webs, and spring legs. The connecting webs are in the form of constricted film hinges. The length of the connecting webs is, preferably, 3 to 10 mm, the width of the connecting webs is 0.5 to 2 mm, and the thickness of the connecting webs at their ends is 0.5 to 1.5 mm and at their constricted center is 0.15 to 1 mm, but, in any event, less than at their ends. The pushbutton configuration is preferably formed in one piece from readily flowing polyacetal, which has a high rigidity and restoring elasticity.

30 Claims, 1 Drawing Sheet

DECOUPLED PUSHBUTTONS

CROSS-REFERENCE TO RELATED APPLICATION

This application is a continuation of copending International Application No. PCT/EP00/11939, filed Nov. 29, 2000, which designated the United States and was not published in English.

BACKGROUND OF THE INVENTION

Field of the Invention

The invention relates to a one-piece pushbutton configuration with at least two neighboring pushbuttons, spring legs, and connecting webs, which largely ensures that, when one pushbutton is operated, neighboring buttons move with it only to an extremely slight extent.

In the course of the general trend toward simplifying production procedures, subassemblies previously assembled from individual parts are nowadays increasingly being produced as integral units. This also applies to units including pushbuttons, button mounts, and button spring mechanisms. After button mounts and button spring mechanisms have been brought together in a female multipoint connector in a first step, it is then attempted also to integrate the pushbuttons in such a unit so that it can be produced in a single process step.

A female multipoint connector is described, for example, by German Patent DE 3034585, which discloses a profile strip including clasps for receiving the pushbuttons and bent, preferably V-shaped connecting webs spaced apart by two clasps each. The pushbuttons are fitted onto the clasps and the flexible connecting webs ensure that the pushbuttons can be pressed down without any difficulty. The springing back of the buttons after pressing down is additionally ensured by separate click springs.

A staggered configuration of female multipoint connectors, formed as a unit, is described in U.S. Pat. No. 4,315,114 to Monti. In such a configuration, the buttons are disposed on two flexible spring legs, which for their part are formed on rigid connecting webs.

A telephone keypad with multi-row operating keys integrated into a female multipoint connector is described in European Plastics News, No. 10, 1983, page 63. Such a keypad is produced by one part of the keys being molded in a first injection-molding step. The keys are completed and provided with a frame, connecting the keys, in a second injection-molding step.

For the flexible operation of the keys, they are connected to the more rigid part of the frame by movable legs.

U.S. Pat. No. 5,270,507 to Nakamura et al. discloses a pushbutton configuration in which neighboring pushbuttons are connected to one another by webs. The webs are configured at their ends facing the pushbuttons as spring legs, so that the pushbuttons are movably mounted by the resilient parts of the webs and the entire pushbutton configuration can rest on an underlying support on the portions of the webs lying between the spring legs. The entire pushbutton configuration is produced from a rubber. The thickness of the webs is substantially constant over their entire length.

By forming spring legs for the pushbuttons and by having flexible connecting webs between neighboring pushbuttons, it is generally intended to achieve the effect that, when a pushbutton is operated, neighboring buttons do not move, it being possible under certain circumstances for an undesired contact or switching effect to be initiated. Because it has not yet been possible for such decoupling between neighboring pushbuttons to be successfully accomplished, the object was to improve the decoupling by further configuration modifications.

A disadvantage of the pushbutton configuration already described is that the spring effect of the spring legs is directly associated with the thickness of the connecting webs. Consequently, if the spring effect is intensified, the coupling of the pushbuttons to one another is always also intensified.

SUMMARY OF THE INVENTION

It is accordingly an object of the invention to provide decoupled pushbuttons that overcome the hereinafore-mentioned disadvantages of the heretofore-known devices of this general type and that eliminate the disadvantages of the prior art by simple construction measures.

With the foregoing and other objects in view, there is provided, in accordance with the invention, a pushbutton configuration including at least two neighboring pushbuttons connected by at least one connecting web to form a pushbutton unit, the connecting web having a constriction, and each of the pushbuttons having a bearing surface and at least two spring legs supported at the bearing surface. Preferably, the pushbutton configuration is used in any kind of household electronic appliance, for example, white goods, computing machines, telephones, and/or audio visual devices.

The present configuration of spring legs and connecting webs creates two functional elements that are independent of one another and can be expediently formed with regard to their actual task and function without the consequence of a functionally impairing influence between the two components. The functional reliability of the button configuration is considerably improved as a consequence.

The restoring force that the spring legs can exert on the pushbutton can, consequently, be brought about independently of the connecting webs. As such, in the case of the pushbutton configuration according to the invention, the connecting webs can be freely dimensioned because the spring action is independent of the thickness of the connecting webs and depends on the nature of the spring legs. It is also advantageous that the mechanical decoupling of neighboring pushbuttons is possible, so that, when one pushbutton is operated, neighboring buttons do not move and no unwanted contact or switching effect of a neighboring button is initiated.

In accordance with yet a further feature of the invention, the spring legs on each pushbutton are disposed laterally offset in relation to one another; the pushbuttons preferably have a base on which the spring legs are provided. The spring legs are preferably formed in a flat-profiled manner and are supported by their free end on the bearing surface. The free end of the spring legs preferably has a portion that is offset parallel to the bearing surface and is supported on the bearing surface. The spring legs may also extend from the base of the pushbuttons (2) under the pushbutton configuration.

In accordance with another feature of the invention, the connecting webs are flexibly configured. It is particularly advantageous for the connecting webs to have a constriction, which is provided either on the upper side, facing the pushbuttons, the underside, or both, or the side faces of the connecting webs. The constriction is preferably provided at the center of the connecting web between the pushbuttons.

In accordance with a further feature of the invention, the constriction is formed as a film hinge; it is quite particularly preferred for the connecting webs to be fashioned in the form of constricted film hinges.

In accordance with an added feature of the invention, the spring legs exert a restoring force on each of the pushbuttons when a respective pushbutton is actuated.

In accordance with an additional feature of the invention, the at least one connecting web is at least one planar connecting web having a center and a thickness, each of the pushbuttons is connected to one another by the at least one planar connecting web, and the constriction is a constriction in the thickness at the center.

In accordance with yet another feature of the invention, the connecting web has a length, a width, an end with an end thickness, and a center with a center thickness, the length is between 3 and 7 mm, the width is between 0.5 and 2 mm, the end thickness is between 0.5 and 1.5 mm, and the center thickness is between 0.15 and 1 mm and is less than a thickness of the end thickness. Preferably, the length is between 5 and 7 mm, the width is between 0.8 and 1.2 mm, the end thickness is between 0.75 and 0.85 mm, and the center thickness is between 0.25 and 0.45 mm.

In accordance with yet an added feature of the invention, when the one pushbutton is pressed down by approximately 1.25 mm, neighboring pushbuttons are moved with the pressed pushbutton by less than 0.63 mm, preferably, by less than 0.5 mm, and, in particular, by at most 0.35 mm.

In accordance with yet an additional feature of the invention, the pushbuttons each have an underside and a base at the underside and the spring legs respectively extend from the base.

In accordance with again another feature of the invention, the pushbuttons and the connecting web are of polyacetal. The pushbutton configuration according to the invention is produced particularly advantageously from an especially rigid polyacetal polymer with great resilience. In such a case, the connecting webs can be constricted down to 0.2 mm without fear of rupture of the connecting webs at the constricted points after the buttons have been in use for a long time. By using a readily flowing polyacetal (HOSTAFORM® C 13031, Ticona GmbH, Frankfurt), it is also made possible for the pushbutton unit to be produced in one injection-molding step in spite of the constrictions, hindering the through-flow of the polymer. Suitable polyacetal homopolymers and copolymers generally have a melt flow index (MVR) of at least 12. Suitable copolymers have a comonomer content of generally less than 3.4% by weight with respect to the monomer trioxane, preferably, less than 2% by weight, in particular, 1.4% by weight.

In accordance with again a further feature of the invention, the connecting web is of an elastomer preparation, in particular, a thermoplastic elastomer preparation.

In accordance with a concomitant feature of the invention, the connecting webs are flexibly configured by the connecting webs being of an elastomer preparation (crosslinked or uncrosslinked), preferably, a thermoplastic elastomer preparation, which has good adhesion with the material of the pushbuttons. It is preferred for the pushbuttons to be of a polyacetal and for the connecting webs to be of a thermoplastic elastomer preparation, as described, for example, in International publication WO 00/20204, U.S. Pat. No. 5,149,589 to Naritomi et al., U.S. Pat. No. 5,002,625 to Naritomi et al., or U.S. Pat. No. 5,472,782 to Naritomi, each of which is incorporated herein by reference. Such a pushbutton configuration is preferably produced by two-component injection molding.

Other features that are considered as characteristic for the invention are set forth in the appended claims.

Although the invention is illustrated and described herein as embodied in decoupled pushbuttons, it is, nevertheless, not intended to be limited to the details shown because various modifications and structural changes may be made therein without departing from the spirit of the invention and within the scope and range of equivalents of the claims.

The construction and method of operation of the invention, however, together with additional objects and advantages thereof, will be best understood from the following description of specific embodiments when read in connection with the accompanying drawings.

DESCRIPTION OF THE PREFERRED EMBODIMENTS

Figure 1:
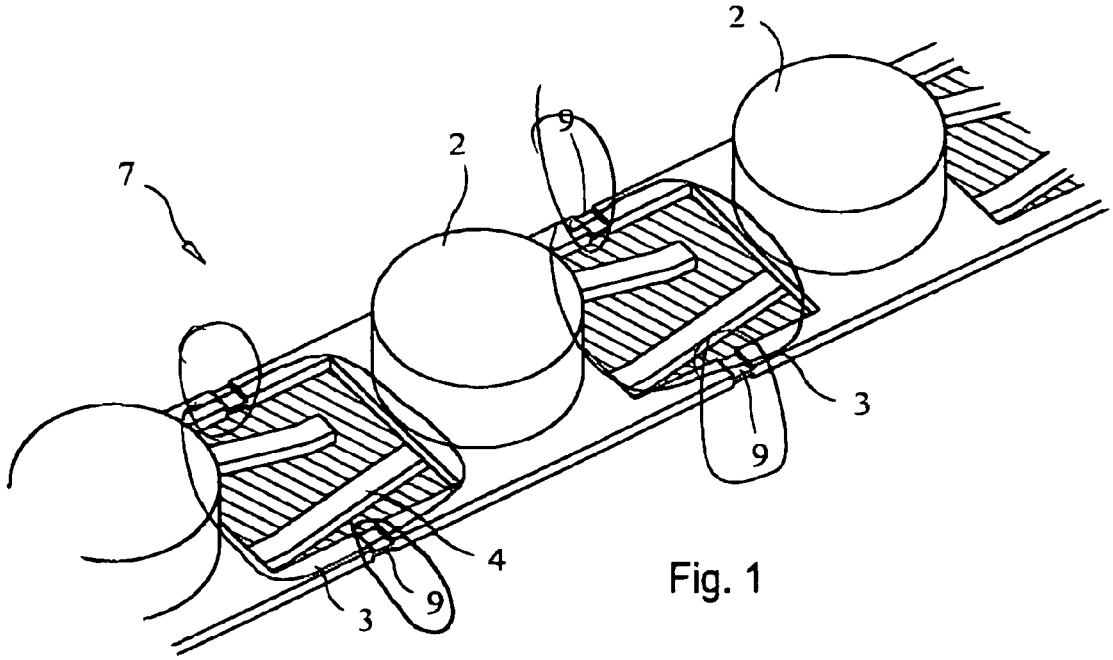
FIG. 1 is a perspective view of a single-row pushbutton configuration according to the invention.

Referring now to the figures of the drawings in detail and first, particularly to FIG. 1 thereof, there is shown a detail of a single-row pushbutton configuration 1 of pushbuttons 2 that are connected to one another by connecting webs 3. On each of the pushbuttons 3 there are two spring legs 4 that extend from the base of the pushbuttons 3 under the pushbutton configuration 1. The spring legs 4 serve for bearing the pushbutton configuration 1 on a bearing surface (shaded area of FIG. 1) or a frame and for returning the pushbutton after pressing down. The connecting webs 3 have a constriction 9 at their center. Such a constriction is configured on the upper side, facing the pushbuttons, of the connecting webs in the illustration, but it may also be configured on the underside or from both sides. The single-row pushbutton configuration 1 can be combined with other rows of pushbuttons or a frame.

On a pushbutton configuration according to FIG. 1 with connecting webs of 6.2 mm in length, 1 mm in width, and a web thickness of 0.8 mm at the end of the button, or 0.35 mm at the constriction, it can be shown by FEM calculations, for example, that, when there is a deformation (pressing down) of one pushbutton by 1.25 mm, the neighboring pushbuttons are moved with it by only 0.35 mm. If the web is 0.8 mm thick in its entire length, with the same deformation of a pushbutton the neighboring pushbuttons are moved with it by 0.63 mm. In the calculations, the material properties of HOSTAFORM® C 13031 (Ticona GmbH) were taken into account as well.

Figure 2:
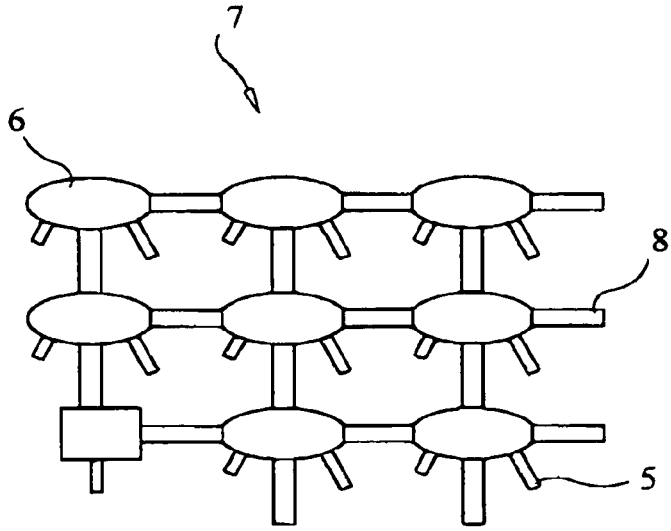
FIG. 2 is a diagrammatical representation of a two-dimensional pushbutton configuration according to the invention.

FIG. 2 illustrates a detail of a two-dimensional pushbutton configuration 5 of pushbuttons 6, which are connected to one another by connecting webs 7, the pushbuttons 6 being movably mounted by the spring legs 8.

The pushbutton configuration according to the invention can be configured, according to requirements, as a pair of buttons, a group of buttons, a row of buttons, or a two-dimensional button configuration. Such a pushbutton configuration is used in any kind of household electronic appliance, for example, in operating panels of household appliances, in particular, what are referred to as white goods such as washing machines, refrigerators, washer dryers, kitchen ovens, etc., as keypads for computing machines, typewriters, computers, and telephones, in particular, cell phones, notebooks, etc., as operating panels for radio, music, video, and TV devices, as operating panels for machines and machine tools or elevators, or as switching and operating panels in vehicles, etc.

In general, the pushbutton configuration according to the invention can be advantageously used, in particular, wherever closely disposed operating buttons have to be accommodated in a space-saving manner in a device or component and it must be ensured at the same time that, when one button is actuated, no neighboring buttons are moved with it and, consequently, under certain circumstances, produce a signal.

We claim:

1. A pushbutton configuration, comprising:

at least two neighboring pushbuttons connected by at least one connecting web to form a pushbutton unit;

said connecting web having a constriction; and each of said pushbuttons having at least two spring legs to be supported at a bearing surface.

2. The pushbutton configuration according to claim 1, wherein said spring legs on each of said pushbuttons laterally offset with respect to one another.

3. The pushbutton configuration according to claim 1, wherein:

each of said spring legs have a free end and a flat-profiled shape; and said free end supports each of said spring legs at the bearing surface.

4. The pushbutton configuration according to claim 1, wherein each of said spring legs has:

a free end; and a portion at said free end offset parallel to the bearing surface and to be supported at the bearing surface.

5. The pushbutton configuration according to claim 1, wherein:

each of said pushbuttons has a base; and said spring legs are disposed on said base.

6. The pushbutton configuration according to claim 1, wherein:

said pushbutton unit has an underside;

each of said pushbuttons has a base; and said spring legs extend from said base at said underside.

7. The pushbutton configuration according to claim 1, wherein said spring legs exert a restoring force on each of said pushbuttons when a respective pushbutton is actuated.

8. The pushbutton configuration according to claim 7, wherein:

said connecting web having a center; and said constriction is disposed at said center.

9. The pushbutton configuration according to claim 1, wherein:

said at least one connecting web is at least one planar connecting web having:

a center; and a thickness;

each of said pushbuttons is connected to one another by said at least one planar connecting web; and said constriction is a constriction in said thickness at said center.

10. The pushbutton configuration according to claim 8, wherein:

said connecting web has an upper side facing said pushbuttons; and said constriction is disposed on said upper side of said connecting web.

11. The pushbutton configuration according to claim 9, wherein:

said connecting web has an upper side facing said pushbuttons; and said constriction is disposed on said upper side of said connecting web.

12. The pushbutton configuration according to claim 8, wherein:

said connecting web has a lower side facing away from said pushbuttons; and said constriction is disposed on said lower side of said connecting web.

13. The pushbutton configuration according to claim 9, wherein:

said connecting web has a lower side facing away from said pushbuttons; and said constriction is disposed on said lower side of said connecting web.

14. The pushbutton configuration according to claim 8, wherein:

said connecting web has:

an upper side facing said pushbuttons; and a lower side facing away from said pushbuttons; and said constriction is disposed on both of said upper and lower sides of said connecting web.

15. The pushbutton configuration according to claim 9, wherein:

said connecting web has:

an upper side facing said pushbuttons; and a lower side facing away from said pushbuttons; and said constriction is disposed on both of said upper and lower sides of said connecting web.

16. The pushbutton configuration according to claim 1, wherein said constriction is formed on said connecting web as a film hinge.

17. The pushbutton configuration according to claim 1, wherein said constriction is a film hinge.

18. The pushbutton configuration according to claim 1, wherein said connecting web is a constricted film hinge.

19. The pushbutton configuration according to claim 1, wherein:

said connecting web has a length, a width, an end with an end thickness, and a center with a center thickness;

said length is between 3 and 7 mm;

said width is between 0.5 and 2 mm;

said end thickness is between 0.5 and 1.5 mm; and said center thickness is between 0.15 and 1 mm and is less than a thickness of said end thickness.

20. The pushbutton configuration according to claim 19, wherein:

said length is between 5 and 7 mm;

said width is between 0.8 and 1.2 mm;

said end thickness is between 0.75 and 0.85 mm; and said center thickness is between 0.25 and 0.45 mm.

21. The pushbutton configuration according to claim 1, wherein:

said pushbuttons include:

one pushbutton; and at least one pushbutton neighboring said one pushbutton; and when said one pushbutton is pressed down by approximately 1.25 mm, said at least one neighboring pushbutton is moved with said one pushbutton by less than 0.63 mm.

22. The pushbutton configuration according to claim 1, wherein:

said pushbuttons include:

one pushbutton; and at least one pushbutton neighboring said one pushbutton; and when said one pushbutton is pressed down by approximately 1.25 mm, said at least one neighboring pushbutton is moved with said one pushbutton by less than 0.5 mm.

23. The pushbutton configuration according to claim 1, wherein:

said pushbuttons include:

one pushbutton; and at least one pushbutton neighboring said one pushbutton; and when said one pushbutton is pressed down by approximately 1.25 mm, said at least one neighboring pushbutton is moved with said one pushbutton by at most 0.35 mm.

24. The pushbutton configuration according to claim 1, wherein:

said pushbuttons each have an underside and a base at said underside; and said spring legs respectively extend from said base.

25. The pushbutton configuration according to claim 1, wherein said pushbuttons and said connecting web are of polyacetal.

26. The pushbutton configuration according to claim 25, wherein said pushbuttons and said connecting web are of one of the group consisting of a polyoxymethylene homopolymer and copolymer with a melt flow index of at least 12.

27. The pushbutton configuration according to claim 1, wherein said pushbuttons and said connecting web are of a polyoxymethylene copolymer with a comonomer content of less than 3.4% by weight.

28. The pushbutton configuration according to claim 1, wherein said connecting web is of an elastomer preparation.

29. The pushbutton configuration according claim 1, wherein said connecting web is of a thermoplastic elastomer preparation.

30. In a household appliance, a pushbutton configuration, comprising:

at least two neighboring pushbuttons connected by at least one connecting web to form a pushbutton unit;

said connecting web having a constriction; and each of said pushbuttons having at least two spring legs to be supported at a bearing surface.

* * * * *